US009368051B2

(12) United States Patent
Mizushiro

(10) Patent No.: US 9,368,051 B2
(45) Date of Patent: Jun. 14, 2016

(54) DISPLAY DEVICE AND DISPLAY CONTROL METHOD

(71) Applicant: SEIKO EPSON CORPORATION, Tokyo (JP)

(72) Inventor: Kenji Mizushiro, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 22 days.

(21) Appl. No.: 14/156,870

(22) Filed: Jan. 16, 2014

(65) Prior Publication Data

US 2014/0210869 A1 Jul. 31, 2014

(30) Foreign Application Priority Data

Jan. 25, 2013 (JP) ..... 2013-011788

(51) Int. Cl.
*G09G 3/00* (2006.01)
*G09G 3/34* (2006.01)
*G09G 3/36* (2006.01)

(52) U.S. Cl.
CPC ..... *G09G 3/003* (2013.01); *G09G 3/3406* (2013.01); *G09G 3/3648* (2013.01); *G09G 2310/06* (2013.01); *G09G 2320/064* (2013.01)

(58) Field of Classification Search
CPC ..... G09G 2310/067; G09G 3/003; G09G 3/3406; G09G 3/3648; G09G 2310/06; G09G 2320/064
See application file for complete search history.

(56) References Cited

U.S. PATENT DOCUMENTS

2005/0062681 A1* 3/2005 Honbo ..... 345/10
2006/0109235 A1* 5/2006 Hung et al. ..... 345/103
2009/0179875 A1* 7/2009 Li ..... G09G 3/3648 345/204
2010/0103205 A1* 4/2010 Iisaka ..... G09G 3/3413 345/690
2011/0157165 A1* 6/2011 Jung et al. ..... 345/419
2013/0093797 A1* 4/2013 Guo ..... 345/690

FOREIGN PATENT DOCUMENTS

CN 1637508 A 7/2005
JP A-2012-49645 3/2012
JP A-2012-113241 6/2012

* cited by examiner

*Primary Examiner* — Ilana Spar
*Assistant Examiner* — Mihir Rayan
(74) *Attorney, Agent, or Firm* — Oliff PLC

(57) ABSTRACT

A display device includes a light modulation device, a light source, a light modulation device control section, and a light source control section. The light modulation device control section controls the light modulation device to select a plurality of scan lines of the light modulation device by K lines (K is an integer not smaller than 2), and write a data signal into the pixels corresponding to the selected scan lines in an image update period, and to select at least a part of the plurality of scan lines line by line, and then write the data signal into the pixels corresponding to the selected scan line in an image display period subsequent to the image update period. The light source control section sets a duty ratio in a part of the image display period to be higher than the duty ratio in another part of the image display period.

9 Claims, 12 Drawing Sheets

DISPLAY DEVICE AND DISPLAY CONTROL METHOD

The entire disclosure of Japanese Patent Application No. 2013-011788, filed Jan. 25, 2013, is expressly incorporated by reference herein.

BACKGROUND

1. Technical Field

The present invention relates to a technology for displaying an image using a light modulation device.

2. Related Art

In a display device using a light modulation device such as a liquid crystal panel, the light modulation device is irradiated with the light emitted by a light source such as a backlight to thereby display an image. In the display device of this kind, there is a problem that it is difficult to sufficiently ensure the brightness of a display image in the case of making the user perceive a stereoscopic image (i.e., a 3D image) with, for example, a frame sequential method of alternately displaying a right-eye image and a left-eye image in a time-sharing manner.

JP-A-2012-49645 (Document 1) and JP-A-2012-113241 (Document 2) each disclose a technology for improving the brightness of the display of a 3D image. Document 1 discloses that a period in which shutters of a pair of stereoscopic glasses can be opened is substantially elongated by disposing an image update period prior to a display period, wherein data signals are supplied while selecting scan lines line by line in the display period, and the data signals are supplied while selecting every plurality of scan lines in the image update period. Document 2 discloses that the shutters are opened prior to the timing at which the light source starts lighting taking the time response of the shutters in the pair of glasses into consideration.

However, in the invention described in Document 1, since the light source is lit uniformly in the display period in which the data signals are supplied while selecting the scan lines line by line, an image with a low vertical resolution is apt to be visually recognized by the user in particular at a timing close to the starting point of the display period. In the invention described in Document 2, the brightness of the display image is ensured by advancing the release timing of the shutters of the pair of glasses, and is therefore, a method of dimming the light source is constant.

SUMMARY

An advantage of some aspects of the invention is to ensure the brightness of a display image while making the low-resolution display image difficult to be visually recognized by the user in the case of displaying the image using the light modulation device.

A display device according to an aspect of the invention includes a light modulation device including a plurality of pixels disposed corresponding to respective intersections between a plurality of scan lines and a plurality of data lines, a light source adapted to irradiate the light modulation device with light in accordance with PWM control, a light modulation device control section adapted to control the light modulation device to select the plurality of scan lines by K lines (K is an integer not smaller than 2), and then write a data signal into the pixels corresponding to the selected scan lines in an image update period, and to select at least a part of the plurality of scan lines line by line, and then write the data signal into the pixels corresponding to the selected scan line in an image display period subsequent to the image update period, and a light source control section adapted to perform the PWM control of the light source so as to set a duty ratio in a part of the image display period to be higher than the duty ratio in another part of the image display period in a case of irradiating the light modulation device with the light with a predetermined luminance.

According to this aspect of the invention, since the light source is put on in a part of the period in priority in accordance with the resolution of the display image in the case of irradiating the pixels with the light with a predetermined luminance in the image display period, it is possible to ensure the brightness of the display image while making the display image with the low resolution difficult to be visually recognized by the user in the case of displaying the image using the light modulation device.

The display device according to the aspect of the invention may be configured such that the light source control section sets the duty ratio in the another part of the image display period to 0% in a case of irradiating the light modulation device with the light with the luminance equal to and lower than a threshold value, and the duty ratio in the part of the image display period to 100%, and the duty ratio in the another part of the image display period to be higher than 0% in a case of irradiating the light modulation device with the light with the luminance higher than the threshold value.

According to this configuration of the invention, in the case in which the light with a predetermined luminance can be applied to the pixels by fully putting on the light source in a part of the image display period corresponding to the resolution of the display image, the light source is not put on in another part of the image display period. Therefore, it is possible to make the display image with the low resolution difficult to be visually recognized by the user.

The display device according to the aspect of the invention may be configured such that the light modulation device control section controls the light modulation device to write the data signal corresponding to a designated grayscale of the pixels corresponding to a first scan line of the plurality of scan lines in the image update period, and to select a second scan line, which is other than the first scan line of the plurality of scan lines, line by line, and then write the data signal corresponding to a designated grayscale of the pixels corresponding to the selected second scan line in a first display period in the image display period, and select the plurality of scan lines line by line and then write the data signal into the pixels corresponding to the selected one of the scan lines in a second display period subsequent to the first display period, and the light source control section sets the duty ratio in the second display period to be higher than the duty ratio in the first display period.

According to this configuration of the invention, since the light source is put on in the period, during which the image with the high resolution is displayed in the entire area of the light modulation device, in priority, it is possible to make the display image with the low resolution difficult to be visually recognized by the user.

The display device according to the aspect of the invention may be configured such that in a case of irradiating the light modulation device with the light in the first display period, the light source control section temporally divides the first display period into a plurality of sub-periods, and sets the duty ratio so that the more posterior the sub-period is located on a time axis, the higher the duty ratio in the sub-period is.

According to this configuration of the invention, since the light source is put on in the period, in which the display area of the high resolution image is large, in priority, even in the case of putting on the light source in the period other than the period during which the high resolution image is displayed in the entire area of the light modulation device, it is possible to make the display image with the low resolution difficult to be visually recognized by the user.

The display device according to the aspect of the invention may be configured such that the light modulation device control section controls the light modulation device to write the data signal corresponding to a designated grayscale of the pixels corresponding to a first scan line of the plurality of scan lines in the image update period, and to select a second scan line, which is other than the first scan line of the plurality of scan lines, line by line, and then write the data signal corresponding to a designated grayscale of the pixels corresponding to the selected second scan line in a first display period in the image display period, and select the plurality of scan lines by K lines and then write the data signal into the pixels corresponding to the selected scan lines in a second display period subsequent to the first display period, and the light source control section sets a duty ratio in a period from when writing of the data signal is performed in the first display period to when writing of the data signal is performed in the second display period to be higher than the duty ratio in the another part of the image display period with respect to the pixels corresponding to predetermined one of the scan lines.

According to this configuration of the invention, since the light source is put on in the period, in which the high resolution image is displayed in a specific area, in priority, even in the case in which there is no or little period in which the high resolution image is displayed in the entire area of the light modulation device, it is possible to make the display image with the low resolution difficult to be visually recognized by the user.

The display device according to the aspect of the invention may be configured such that the light modulation device control section controls the light modulation device to select the second scan line line by line, and then write the data signal corresponding to a designated grayscale of the pixels corresponding to the selected second scan line in a third display period after the second display period in the image display period, and the light source control section sets a duty ratio in a period from when writing of the data signal is performed in the third display period to when the third display period ends to be higher than the duty ratio in the another part of the image display period with respect to the pixels corresponding to the predetermined one of the scan lines.

According to this configuration of the invention, since the light source is put on in the period, in which the high resolution image is displayed in a specific area, in priority, in the case of selecting the scan lines by K lines and then writing the data signal in the image display period, it is possible to ensure the brightness of the display image while making the display image with the low resolution difficult to be visually recognized by the user.

The display device according to the aspect of the invention may be configured such that the light modulation device control section controls the light modulation device to write the data signal representing one of a left-eye image and a right-eye image in 3D image display, and the light source control section sets a duty ratio in the image update period to 0%.

According to this configuration of the invention, by fully putting off the light source in the image update period in the case of displaying the 3D image, it is possible to prevent the crosstalk causing the right-eye image to enter the left eye of the user or the left-eye image to enter the right eye of the user from occurring.

The display device according to the aspect of the invention may be configured such that the light modulation device control section controls the light modulation device to write the data signal representing a 2D image, and the light source control section sets a duty ratio in the image update period to be higher than 0% in a case in which the duty ratio in the image display period is 100%.

According to this configuration of the invention, in the case of displaying the 2D image, if it is unachievable to apply the light with a predetermined luminance even by fully putting on the light source in the image display period, the light source is put on in the image update period. Therefore, it is possible to further improve the brightness of the display image.

It should be noted that the invention can also be implemented as a display control method besides the display device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Some embodiments of the invention will hereinafter be explained with reference to the accompanying drawings.

First Embodiment

A first embodiment of the invention will be explained.

Figure 1:
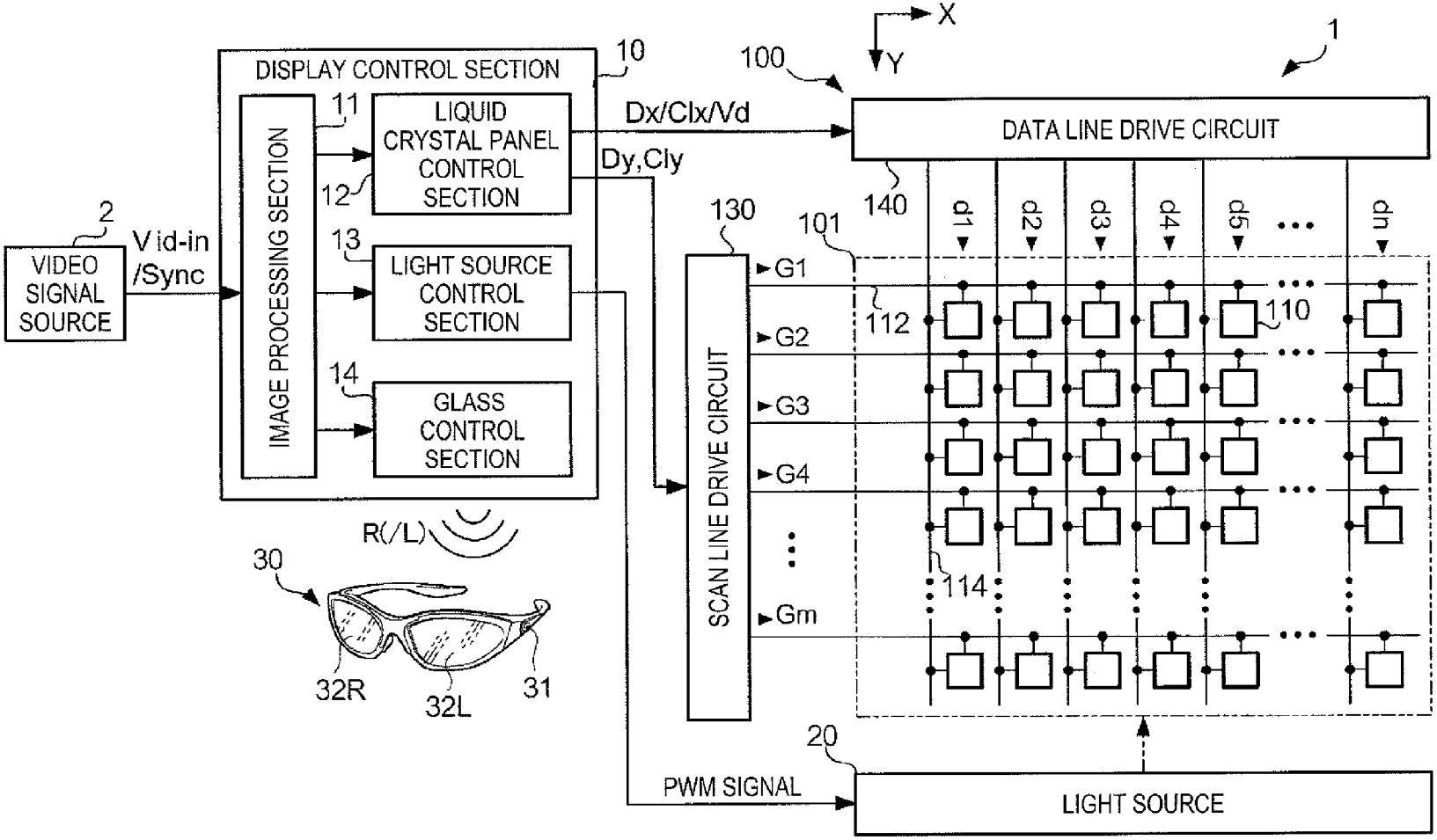
FIG. 1 is a block diagram showing an overall configuration of a display device according to an embodiment of the invention.

FIG. 1 is a block diagram showing an overall configuration of a display device according to the present embodiment. A liquid crystal display device 1 is a display device for displaying an image so that the user can perceive a 3D image in a state of wearing a pair of 3D glasses 30. As shown in FIG. 1, the liquid crystal display device 1 displays the 3D image with the frame sequential method based on a video signal Vid-in and a sync signal Sync supplied from a video signal source 2.

The video signal source 2 is, for example, an image reproduction device, and more specifically, a device (e.g., a DVD playback device or a personal computer) for reproducing an image recorded on a recording medium (an optical recording medium, a magnetic recording medium, or the like), or a device (e.g., a set-top box of a cable television service) for reproducing an image from video data delivered via a network.

The video signal source 2 supplies the liquid crystal display device 1 with the video signal Vid-in in sync with the sync signal Sync. The video signal Vid-in is digital data for respectively designating the grayscale levels of the pixels in a liquid crystal panel 100, and is supplied in the order of the scan in accordance with a vertical scan signal, a horizontal scan signal, and a dot clock signal (all not shown) included in the sync signal Sync. An image represented by the video signal Vid-in expresses either one of the right-eye image and the left-eye image in the 3D image.

The liquid crystal display device 1 is provided with the liquid crystal panel 100, a light source 20, and a display control section 10. The liquid crystal panel 100 is a display section having a plurality of pixels 110 arranged in a matrix in a display area 101. In a detailed description, in the display area 101, there are m scan Lines 112 extending in an X (horizontal) direction in FIG. 1 on the one hand, n data lines 114 extending in a Y (vertical) direction in FIG. 1 while keeping electrical insulation with the scan lines 112 on the other hand (m and n are each a natural number equal to or greater than 2). Further, the pixels 110 are arranged so as to correspond respectively to the intersections between the plurality of scan lines 112 and the plurality of data lines 114. In the present embodiment, the pixels 110 are arranged in a matrix composed of m vertical rows and n horizontal columns.

Figure 2:
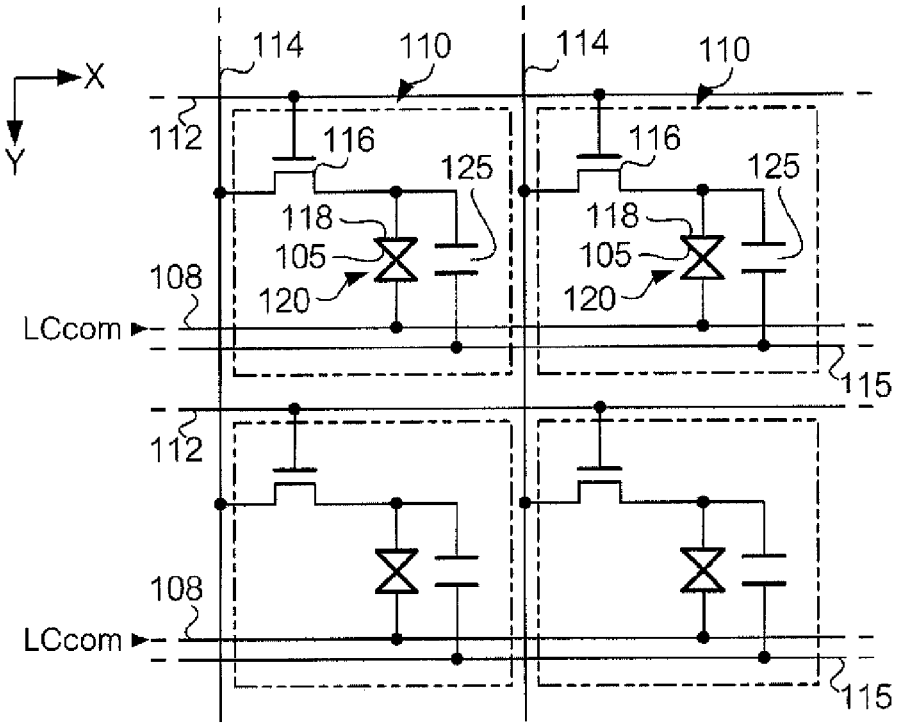
FIG. 2 is a diagram showing an equivalent circuit in a light modulation device.

FIG. 2 is a diagram showing an equivalent circuit in the liquid crystal panel 100.

The liquid crystal panel 100 is a light modulation device for modulating the incident light in accordance with image data. As shown in FIG. 2, the liquid crystal panel 100 has a configuration in which liquid crystal elements 120 are arranged so as to correspond to the intersections between the scan lines 112 and the data lines 114, wherein each of the liquid crystal elements 120 has a liquid crystal 105 sandwiched between a pixel electrode 118 and a common electrode 108. As shown in FIG. 2, in the equivalent circuit in the liquid crystal panel 100, an auxiliary capacitance (a storage capacitance) 125 is disposed in parallel to each of the liquid crystal elements 120. The auxiliary capacitance 125 has one end connected to the pixel electrode 118, and the other end commonly connected to a capacitance line 115. The capacitance line 115 is kept at a voltage constant with time.

Here, when the scan line 112 becomes in an H level, a TFT 116 having the gate electrode connected to that scan line becomes in an ON state to thereby connect the pixel electrode 118 to the data line 114. Therefore, by supplying the data line 114 with the data signal having a voltage corresponding to the grayscale when the scan line 112 is in the H level, the data signal is applied to the pixel electrode 118 via the TFT 116 thus set to the ON state. When the scan line 112 becomes in an L level, the TFT 116 becomes in an OFF state, and the voltage applied to the pixel electrode 118 is held by the capacitance of the liquid crystal element 120 and the auxiliary capacitance 125.

In the liquid crystal element 120, the molecular orientation state of the liquid crystal 105 varies in accordance with an electrical field generated by the pixel electrode 118 and the common electrode 108. Therefore, the liquid crystal element 120 becomes to have a transmittance corresponding to the applied and held voltage in the case in which the liquid crystal element 120 is of a transmissive type. Since in the liquid crystal panel 100, the transmittance varies by the liquid crystal element 120, the liquid crystal element 120 corresponds to the pixel.

It should be noted that in the present embodiment a vertical alignment (VA) type liquid crystal is used as the liquid crystal 105, and there is adopted a normally black mode in which the liquid crystal element 120 becomes in a black state when no voltage is applied.

Going back to FIG. 1, the explanation will be presented.

A scan line drive circuit 130 sequentially shifts a start pulse Dy supplied from the display control section 10 in accordance with a clock signal Cly, and then supplies the result to the scan lines 112 corresponding to the 1st, 2nd, 3rd, 4th, . . . , and m-th rows as scan signals G1, G2, G3, G4, . . . , and Gm, respectively.

A data line drive circuit 140 supplies the data lines 114 corresponding to the 1st, 2nd, 3rd, . . . , and n-th columns with data signals d1, d2, d3, d4, d5, . . . , and dn, respectively, based on a start pulse Dx and a clock signal Clx supplied from the display control section 10.

In the liquid crystal display device 1, one of the scan lines 112 is selected by a drive circuit having the scan line drive circuit 130 and the data line drive circuit 140 cooperating with each other, and then the data signal is written to the pixels 110 corresponding to the scan line 112 thus selected.

The light source 20 irradiates the liquid crystal panel 100 with the light in accordance with the pulse width modulation (CNN) control. The light source 20 is a light source device exemplified by a light emitting diode (LED) for emitting light having a R (red) color, a G (green) color, or a. B (blue) color, a semiconductor laser, or a white light source such as a halogen lamp. The light source 20 is put on or off due to the PWM control performed in accordance with the PWM signal supplied from the display control section 10.

The display control section 10 is responsible for the control for displaying an image (picture) on the liquid crystal panel 100. The display control section 10 has an image processing section 11, a liquid crystal panel control section 12, a light source control section 13, and a glass control section 14.

The image processing section 11 performs a predetermined process based on the video signal Vid-in and the sync signal Sync supplied from the video signal source 2. The image processing section 11 performs the predetermined image processing (e.g., a 2D/3D conversion process, a frame interpolation process, a resolution enhancement process, a keystone distortion correction process, and a color conversion process) on the video signal Vid-in, and then supplies the liquid crystal panel control section 12 with the video signal Vd obtained by the image processing in sync with the sync signal used for the vertical synchronization and the horizontal synchronization. Further, the image processing section 11 analyzes the video signal Vid-in to detect average values and peaks of the luminance and the chromaticity of the image represented by the video signal Vid-in, and then obtains a required luminance to the light source 20. The image processing section 11 supplies the light source control section 13 with the required luminance thus obtained. Further, the image processing section 11 supplies the light source control section 13 with at least the vertical scan signal in the sync signal Sync. Further, based on the sync signal Sync, the image processing section 11 supplies the glass control section 14 with a sync signal for controlling an open/close state of each of the liquid crystal shutters 32L, 32R of the pair of 3D glasses 30 in sync with the video signal Vd.

The liquid crystal panel control section 12 controls the liquid crystal panel 100 as a light modulation device based on the video signal Vd and the sync signal supplied form the image processing section 11. The liquid crystal panel control section 12 supplies the scan line drive circuit 130 with the start pulse Dy and the clock signal Cly. Further, the liquid crystal panel control section 12 supplies the data line drive circuit 140 with the start pulse Dx, the clock signal Clx, and the video signal Vd. The liquid crystal control section 12 is a light modulation device control section for controlling the light modulation device.

The light source control section 13 generates the PWM signal with a predetermined duty ratio based on the required luminance supplied from the image processing section 11, and then supplies the light source 20 with the PWM signal to thereby perform the PWM control of the light source 20. The light source control section 13 generates the PWM signal in sync with the vertical sync signal included in the sync signal Sync. The light source 20 supplied with the PWM signal is put on in the case in which the PWM signal is in the ON state (in the high level), and is put off in the case in which the PWM signal is in the OFF state (in the low level).

The glass control section 14 controls the pair of 3D glasses 30 based on the sync signal supplied from the image processing section 11. The glass control section 14 transmits, to the pair of 3D glasses 30, a control signal R(/L) using, for example, infrared communication or radio communication. The control signal R(/L) is a control signal representing whether it is a display period for the right-eye image or a display period for the left-eye image when displaying a 3D image. The pair of 3D glasses 30 has a right-eye lens portion formed of a liquid crystal shutter 32R, and a left-eye lens portion formed of a liquid crystal shutter 32L. The liquid crystal shutters 32R, 32L are respectively controlled to be in a transmissive state or a non-transmissive state in accordance with, for example, the control signal R (/L) received by a receiving section 31. In a detailed explanation, when displaying a 3D image, the liquid crystal shutter 32R becomes in the transmissive state while the liquid crystal shutter 32L becomes in the non-transmissive state in a right-eye opening period described later, and the liquid crystal shutter 32R becomes in the non-transmissive state while the liquid crystal shutter 32L becomes in the transmissive state in a left-eye opening period. In other periods, both of the liquid crystal shutters 32R and 32L become in the non-transmissive state.

It should be noted that in the case in which the liquid crystal display device 1 displays a 2D image, both of the liquid crystal shutters 32R and 32L becomes in the transmissive state irrespectively of the control signal R(/L).

Figure 3:
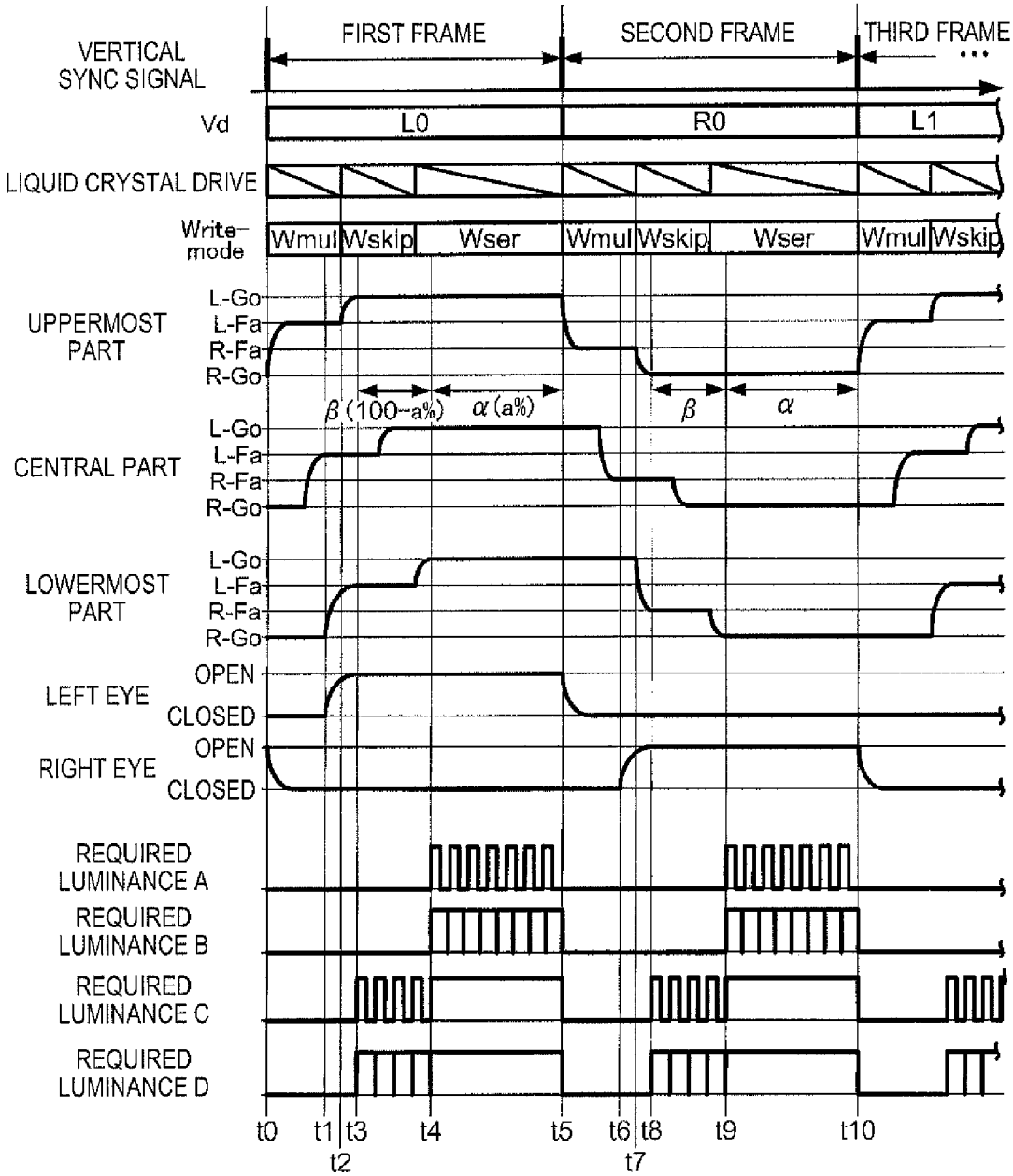
FIG. 3 is an explanatory diagram of an action of a display control section according to a first embodiment of the invention, and states of the light modulation device and a light source.

FIG. 3 is a diagram for explaining the action of the display control section 10, and changes in state of the liquid crystal panel 100 and the light source 20 in accordance with the action of the display control section 10.

As shown in FIG. 3, the display control section 10 controls the liquid crystal panel 100 and the light source 20 to display the left-eye image and the right-eye image provided with parallax with each other on the liquid crystal panel 100 in a time-sharing manner (see the column of "Vd" in FIG. 3). On this occasion, the display control section 10 performs the control for displaying the left-eye image in odd frames and displaying the right-eye image in even frames. FIG. 3 shows a first frame for displaying the left-eye image L0 as a representative of the odd frames, and a second frame for displaying the right-eye image R0 as a representative of the even frames.

When selecting the m scan lines 112, the display control section 10 controls the liquid crystal panel 100 to sequentially select all or some of the scan lines 112 in a direction from the top to the bottom of the liquid crystal panel 100 (i.e., in a direction from the first row to the m-th row) (see the column of "LIQUID CRYSTAL DRIVE" in FIG. 3). In the present embodiment, the display control section 10 divides one frame into three periods, and selects a writing mode in every period obtained by dividing the frame. Further, the display control section 10 controls the liquid crystal panel 100 to select the scan lines 112 using the method corresponding to the writing mode thus selected, and then write the data signal to the pixels 110 corresponding to the scan lines 112 thus selected (see the column of "Write-mode" in FIG. 3).

The first period in one frame is a period for updating the image to be displayed by the liquid crystal panel 100 from the previous frame to the present frame. From the gist described above, the first period in one frame is hereinafter referred to as an "image update period." The periods other than the image update period in one frame, here the second and third periods, are the periods following the image update period, and are the periods for making the user visually recognize the image to be displayed on the liquid crystal panel 100. From the gist described above, the periods following the image update period in one frame are hereinafter referred to as "image display periods."

The writing mode of the present embodiment includes a multi-line writing mode Wmul, a single-line skip writing mode Wskip, and a single-line sequential writing mode Wser. During the image update period, the display control section 10 selects the multi-line writing mode Wmul. During the early part (a first display period) of the image display period, the display control section 10 selects the single-line skip writing mode Wskip. During the latter part (a second display period) of the image display period, the display control section 10 selects the single-line sequential writing mode Wser.

Figure 4A:
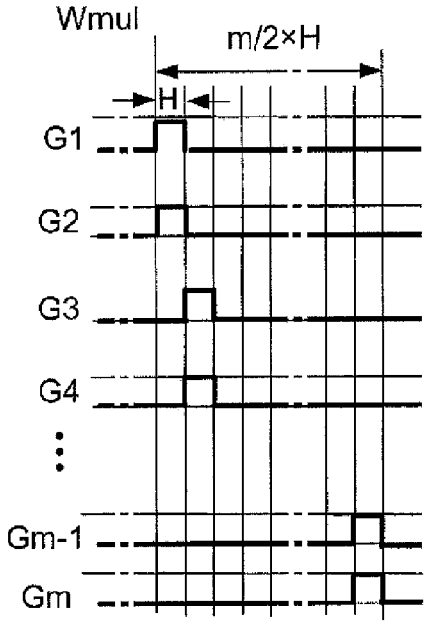
FIGS. 4A through 4C are explanatory diagrams of a writing mode.
Figure 4B:
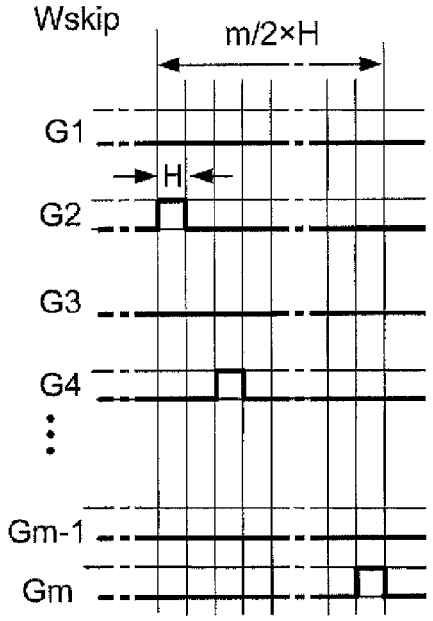
Figure 4C:
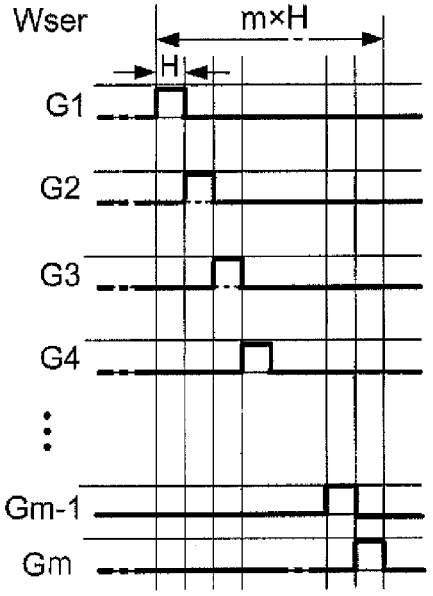

FIGS. 4A through 4C are diagrams for explaining the writing mode.

As shown in FIG. 4A, the multi-line writing mode Wmul is a writing mode in which the m scan lines 112 are selected by K (K is an integer equal to or greater than 2) lines, and the data signal is written into the pixels 110 corresponding to the selected ones of the scan lines 112. In the present embodiment, K=2 is assumed. When the multi-line writing mode Wmul is selected, the display control section 10 selects two scan lines 112 adjacent to each other simultaneously as a horizontal scan period H. Therefore, the time necessary for writing the data signal into all of the pixels 110 of the liquid crystal panel 100 can be expressed as m/2×H.

Due to the operation of writing the data signal in the multi-line writing mode Wmul, the same data signal is written into the pixels 110 corresponding to the two scan lines thus selected simultaneously. Here, the display control section 10 controls the liquid crystal panel 100 to write the data signal corresponding to the designated grayscale of the pixel corresponding to each of the odd-numbered (1st, 3rd, 5th, . . . ) scan lines 112 (first scan lines) of the m scan lines 112. The designated grayscale is the grayscale level designated pixel by pixel by the video signal Vd (the video signal Vid-in).

As shown in FIG. 4B, the single-line skip writing mode Wskip is a writing mode in which some of the m scan lines 112 are selected by L (L is an integer not smaller than 1 and not greater than K−1) lines, and the data signal is written into the pixels 110 corresponding to the selected ones of the scan lines 112. In the present embodiment, L=1 is assumed. More specifically, the single-line skip writing mode Wskip is a mode for writing the data signal corresponding to the designated grayscale with respect to the pixels 110 to which the data signal of the designated grayscale has not been written in the multi-line writing mode Wmul. In the case of K=2, the display control section 10 controls the liquid crystal panel 100 to select the m scan lines 112 every other line as the horizontal scan period H. Here, the display control section 10 performs the control so that the data signal corresponding to the designated grayscale of the pixel corresponding to each of the even-numbered (2nd, 4th, 6th, scan lines 112 (second scan lines) of the m scan lines 112 is written. Therefore, the time necessary for writing the data signal into all of the pixels 110 of the liquid crystal panel 100 can be expressed as m/2×H.

As shown in FIG. 4C, the single-line sequential writing mode Wser is a writing mode in which the m scan lines 112 are selected line by line, and the data signal is written into the pixels 110 corresponding to the selected one of the scan lines 112. The display control section 10 controls the liquid crystal panel 100 to select all of them scan lines 112 line by line as the horizontal scan period H. Therefore, the time necessary for writing the data signal into all of the pixels 110 of the liquid crystal panel 100 can be expressed as m×H. In other words, the time necessary for writing the data signal to all of the pixels 110 in the single-line sequential writing mode Wser is twice as long as the time in the case of the multi-line writing mode Wmul or the single-line skip writing mode Wskip.

Going back to FIG. 3, the temporal variation in resolution of the display image of the liquid crystal panel 100 will be explained. FIG. 3 shows the temporal variation in resolution with respect to the pixels 110 in the uppermost part (i.e., the first row; see the column of "UPPERMOST PART" in FIG. 3) of the screen, the central part (i.e., m/2 row; see the column of "CENTRAL PART" in FIG. 3) of the screen, and the lowermost part (i.e., m-th row; see the column of "LOWERMOST PART" in FIG. 3) of the screen. In FIG. 3, "L-Fa" denotes that a left-eye image with low resolution is displayed, and "L-Go" denotes that a left-eye image with high resolution is displayed. Further, "R-Fa" denotes that a right-eye image with low resolution is displayed, and "R-Go" denotes that a right-eye image with high resolution is displayed.

The case, in which the resolution of the display image of the liquid crystal panel 100 is low, specifically denotes the case in which there is exerted an influence of the pixels 110 to which the data signal corresponding to the designated grayscale in the video signal Vd (the video signal Vid-in) has not been written. The case, in which the resolution of the display image of the liquid crystal panel 100 is high, denotes the case in which the image display is performed with the pixels 110 to which the data signal corresponding to the designated grayscale in the video signal Vd (the video signal Vid-in) has been written without being affected by the influence.

When the image update period of the first frame begins at a time point t0, the display control section 10 selects the multi-line writing mode Wmul, and controls the liquid crystal panel 100 to start writing the data signal for displaying the left-eye image L0. As described above, since the writing of the data signal is performed sequentially from the pixels 110 in the uppermost part of the screen of the liquid crystal panel 100, the left-eye image L0 (L-Fa) with the low resolution is displayed in the uppermost part of the screen immediately after the time point t0. Here, although the data signal corresponding to the designated grayscale is written into the pixels 110 in the first row, the data signal corresponding to the designated grayscale is not written into the pixels 110 in the second row. Therefore, it can be said that the resolution of the image in the uppermost part is low. On the other hand, regarding the pixels 110 in the central part of the screen and the lowermost part of the screen, since the writing of the data signal in the image update period has not yet been performed, the image in the previous frame, namely the right-eye image (R-Go) with the high resolution, is kept remaining. At the timing when a certain time has elapsed after the time point t0, the left-eye image L0 (L-Fa) with the low resolution is displayed in the central part of the screen. In retard of this timing, the left-eye image L0 (L-Fa) with the low resolution is displayed in the lowermost part of the screen (see time points t0 through t2).

As described above, since the multi-line writing mode Wmul is selected in the image update period, the vertical resolution of the liquid crystal panel 100 becomes ½ times (1/K times) the resolution obtained in the case in which the data signal corresponding to the designated grayscale is written into all of the pixels 110. On the other hand, the time necessary for updating the whole of the liquid crystal panel 100 to the image of the present frame is sufficiently ½ times (1/K times) the time necessary in the case of selecting the scan lines 112 line by line.

In the image update period, the image of the previous frame remains in at least a part of the liquid crystal panel 100. Therefore, in order to inhibit the crosstalk from occurring, the display control section 10 performs the control so that both of the liquid crystal shutters 32L, 32R of the pair of 3D glasses 30 are set to a closed state during the image update period to prevent the display image of the liquid crystal panel 100 from being visually recognized by the user (see the columns of "LEFT EYE" and "RIGHT EYE" in FIG. 3). It should be noted that the display control section 10 transmits the control signal R(/L) so as to make the liquid crystal shutter 32L of the pair of 3D glasses 30 make a transition from the closed state to an open state at the time point t1 prior to the time point t2 when the image update period is terminated. Since the time corresponding to the liquid crystal response is necessary for the liquid crystal shutter 32L to make a transition from the closed state to the open state, the display control section 10 transmits the control signal R(/L) taking the time into consideration. By substantially elongating the period during which the liquid crystal shutter 32L is in the open state as described above, it is possible to enhance the brightness of the display image perceived by the user.

When the early part of the image display period of the first frame begins at the time point t2, the display control section 10 selects the single-line skip writing mode Wskip, and controls the liquid crystal panel 100 to start writing the data signal for displaying the left-eye image L0. In the liquid crystal panel 100, the left-eye image L0 (L-Go) with the high resolution is displayed in the uppermost part of the screen at the time point t3 immediately after the time point t2. On the other hand, regarding the pixels 110 in the central part of the screen and the lowermost part of the screen, since the writing of the data signal in the image display period has not yet been performed, the left-eye image L0 (L-Fa) with the low resolution is kept displayed. At the timing when a certain time has elapsed after the time point t2, the left-eye image L0 (L-Go) with the high resolution is displayed in the central part of the screen. In retard of this timing, the left-eye image L0 (L-Go) with the high resolution is displayed in the lowermost part of the screen (see time points t2 through t4). At the time point t4, the left-eye image L0 with the high resolution is displayed in the entire area of the liquid crystal panel 100.

As described above, in the early part of the image display period, there exist the area in the state with high vertical resolution, and the area with the vertical resolution ½ times (1/K times) as high as the vertical resolution of the area with the high vertical resolution in a mixed manner. Further, in the early part of the image display period, the longer time elapses after the writing of the data signal has started, the larger the area with the high vertical resolution becomes.

When the latter part of the image display period of the first frame begins, the display control section 10 selects the single-line sequential writing mode Wser, and controls the liquid crystal panel 100 to start writing the data signal for displaying the left-eye image L0. Here, due to the writing of the data signal in the early part of the image display period, the left-eye image L0 with the high resolution has already been displayed in the entire area of the liquid crystal panel 100. Therefore, during the latter part of the image display period, basically no variation in resolution occurs, and the left-eye image L0 with the high resolution is displayed in the entire area of the liquid crystal panel 100.

The display control section 10 transmits the control signal R(/L) so as to make the liquid crystal shutter 32L of the pair of 3D glasses 30 make a transition from the open state to the closed state at the time point t5 when the latter part of the image display period is terminated.

The explanation of the action performed by the display control section 10 in the first frame the odd frames) is described hereinabove.

Then, the explanation of the action performed by the display control section 10 in the second frame (the even frames) for displaying the right-eye image R0 will be described. Basically, the display control section 10 acts in substantially the same manner as the case of the first frame also in the second frame except the replacement of the left-eye image L0 by the right-eye image R0.

When the image update period of the second frame begins at the time point t5, the display control section 10 selects the multi-line writing mode Wmul, and starts writing the data signal for displaying the right-eye image R0. Then, immediately after the time point t5, the right-eye image R0 (R-Fa) with the low resolution is displayed in the uppermost part of the screen. On the other hand, regarding the pixels 110 in the central part of the screen and the lowermost part of the screen, the left-eye image L0 (L-Go) with the high resolution of the previous frame is still kept displayed. At the timing when a certain time has elapsed after the time point t5, the right-eye image R0 (R-Fa) with the low resolution is displayed in the central part of the screen. In retard of this timing, the right-eye image R0 (R-Fa) with the low resolution is displayed in the lowermost part of the screen (see time points t5 through t7).

Further, the display control section 10 performs the control so that both of the liquid crystal shutters 32L, 32R of the pair of 3D glasses 30 are set to the closed state during the image update period to prevent the display image of the liquid crystal panel 100 from being visually recognized by the user. It should be noted that the display control section 10 transmits the control signal R(/L) so as to make the liquid crystal shutter 32R of the pair of 3D glasses 30 make a transition from the closed state to the open state at the time point 16 prior to the time point t7 when the image update period is terminated.

When the early part of the image display period of the second frame begins at the time point t7, the display control section 10 selects the single-line skip writing mode Wskip, and starts writing the data signal for displaying the right-eye image R0. Thus, at the time point t8 immediately after the time point t7, the right-eye image R0 (R-Go) with the high resolution is displayed in the uppermost part of the screen. On the other hand, regarding the pixels 110 in the central part of the screen and the lowermost part of the screen, since the writing of the data signal in the image display period has not yet been performed, the right-eye image R0 (R-Fa) with the low resolution is kept displayed. At the timing when a certain time has elapsed after the time point t7, the right-eye image R0 (R-Go) with the high resolution is displayed in the central part of the screen. In retard of this timing, the right-eye image R0 (R-Go) with the high resolution is displayed in the lowermost part of the screen (see time points t7 through t9). At the time point t9, the right-eye image R0 with the high resolution is displayed in the entire area of the liquid crystal panel 100.

When the latter part of the image display period of the second frame begins, the display control section 10 selects the single-line sequential writing mode Wser, and starts writing the data signal for displaying the right-eye image R0. Due to the writing of the data signal in the early part of the image display period, the right-eye image R0 with the high resolution has already been displayed in the entire area of the liquid crystal panel 100. Therefore, during the latter part of the image display period, basically no variation in resolution occurs, and the right-eye image R0 with the high resolution is displayed in the entire area of the liquid crystal panel 100.

The display control section 10 transmits the control signal R (/L) so as to make the liquid crystal shutter 32R of the pair of 3D glasses 30 make a transition from the open state to the closed state at the time point t10 when the latter part of the image display period is terminated.

The explanation of the action performed by the display control section 10 in the second frame (the even frames) is described hereinabove.

Thereafter, the liquid crystal display device 1 acts in the odd frames similarly to the case of the first frame, and acts in the even frames similarly to the case of the second frame.

As is understood from the operational explanation of the display control device 10 described hereinabove, in the first frame, the period during which the left-eye image (L-Go) with the high resolution is displayed in the entire area of the liquid crystal panel 100 is a period $\alpha$ from the time point t4 to the time point t5, which is a % of the period during which the liquid crystal shutter 32L is in the open state. Further, in the period during which the liquid crystal shutter 32L is in the open state, the period during which the left-eye image (L-Go) with the high resolution is displayed in a part of the liquid crystal panel 100 is a period $\beta$ from the time point t3 to the time point t4, which is 100-a % of the period during which the liquid crystal shutter 32L is in the open state. The period $\alpha$ includes the latter part of the image display period, and the period $\beta$ includes the early part of the image display period. The value of a is affected by the liquid crystal response and so on of the liquid crystal element 120 to be precise, but can be said to be ⅔ of the period during which the liquid crystal shutter 32L is in the open state. In contrast, in the rest, namely ⅓, of the period during which the liquid crystal shutter 32L is in the open state, the left-eye image (L-Go) with the high resolution is displayed in a part of the liquid crystal panel 100.

Similarly, in the second frame, the period during which the right-eye image (R-Go) with the high resolution is displayed in the entire area of the liquid crystal panel 100 is a period $\alpha$ from the time point t9 to the time point t10, which is a % of the period during which the liquid crystal shutter 32R is in the open state. Further, in the period during which the liquid crystal shutter 32R is in the open state, the period during which the right-eye image (R-Go) with the high resolution is displayed in a part of the liquid crystal panel 100 is a period $\beta$ from the time point t8 to the time point t9, which is 100-a % of the period during which the liquid crystal shutter 32R is in the open state.

Therefore, in the case of irradiating the liquid crystal panel 100 with the light emitted by the light source 20, the display control section 10 performs the PWM control of the light source 20 so as to put on the light source 20 in the period α, during which the image with the high resolution is displayed in the entire area of the liquid crystal panel 100, in priority. On this occasion, in the case in which the light can be applied with a required luminance even by putting on the light source 20 only in the period α, the display control section 10 entirely puts off the light source 20 (i.e., sets the duty ratio to 0%) in the period β. In contrast, in the case in which the light cannot be applied with the required luminance even by putting on (here, full-lighting at a duty ratio of 100%) the light source 20 only in the period α, the display control section 10 performs the PWM control (i.e., raises the duty ratio to a level higher than 0%) of the light source 20 so as to put on the light source 20 in the period β.

Figure 5:
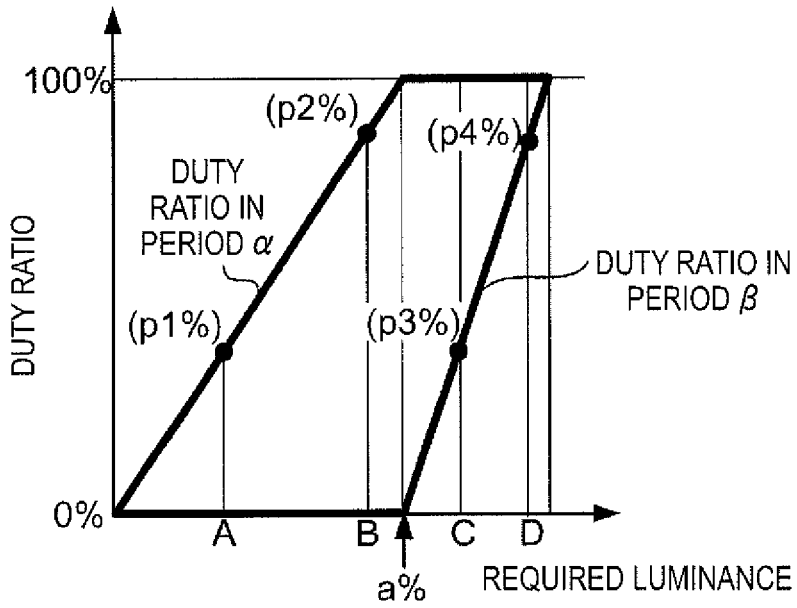
FIG. 5 is an explanatory diagram of a relationship between required luminance and a duty ratio of PWM control according to the embodiment.

FIG. 5 is a graph showing a relationship between the required luminance and the duty ratio in the PWM control. In the graph of FIG. 5, the horizontal axis corresponds to the required luminance, and the vertical axis corresponds to the duty ratio in the PWM control. A look-up table defining the relationship between the required luminance and the duty ratio in the PWM control is stored in, for example, an internal memory of the light source control section 13.

It should be noted that the relationship between the required luminance and the duty ratio shown in FIG. 5 can also be derived by, for example, the light source control section 13 using calculation, besides the configuration of defining the relationship by the look-up table.

As shown in FIGS. 3 and 5, in the case in which the required luminance is "A," the display control section 10 sets the duty ratio in the period β to 0%, and the duty ratio in the period α to p1% (>0). In the case in which the required luminance is "B" brighter than "A," the display control section 10 sets the duty ratio in the period β to 0%, and the duty ratio in the period α to p2% (where p2>p1).

In the case in which the required luminance is equal to or lower than the luminance (a threshold value) obtained in the case of putting on the light source 20 at full-lighting in the period α, the display control section 10 puts on the light source 20 only in the period α, and set the light source 20 to full-extinction in the period β for irradiating the liquid crystal panel 100 with light with the required luminance. Thus, it is possible to make the user visually recognize only the display image with the high resolution while preventing the display image with the low resolution existing in the early part of the image display period from being visually recognized by the user.

In contrast, in the case in which the required luminance exceeds the luminance (the threshold value) obtained in the case of putting on the light source 20 at full-lighting in the period α, the display control section 10 performs the PWM control of the light source 20 so as to put on the light source 20 also in the period β in addition to the period α. In the case in which the required luminance is "C," the display control section 10 sets the duty ratio in the period β to p3%, and the duty ratio in the period α to 100% (full-lighting). In the case in which the required luminance is "D" brighter than "C," the display control section 10 sets the duty ratio in the period β to p4% (where p4>p3), and the duty ratio in the period α to 100% (full-lighting).

Even if the required luminance is equal to or higher than the threshold value, it is possible for the display control section 10 to make the image with the low resolution difficult to be visually recognized by the user by setting the lighting period of the light source 20 in the period β to be as short as possible.

As in the first embodiment explained hereinabove, in the case of irradiating the liquid crystal panel 100 with the light by performing the PWM control of the light source 20, the liquid crystal display device 1 puts on the light source 20 in the period, during which the image with the high resolution is displayed in the entire area of the liquid crystal panel 100, in priority. Only in the case in which the required luminance is high, the liquid crystal display device 1 puts on the light source 20 also in the period during which the image with the low resolution is displayed in a part of the liquid crystal panel 100. Due to the light source control described above, according to the liquid crystal display device 1, the brightness of the display image can be ensured while making the image with the low resolution difficult to be visually recognized by the user.

For example, in the case of displaying a movie on the liquid crystal panel 100, there is often the case in which the screen is always in a dark state. In this case, since the liquid crystal display device 1 always applies the light with such low luminance as the required luminance A, B described above using the light source 20, there is no chance that the image with the low resolution is visually recognized by the user.

Incidentally, even in the case of putting on the light source 20 in the period β including the early part of the image display period, the longer the time, which has elapsed from the beginning of the early part, becomes, the larger the proportion of the area of the state with the high vertical resolution becomes. Therefore, in the case of putting on the light source 20 in the period β, it is also possible for the display control section 10 to put on the light source 20 while giving a higher priority to the period having a more posterior position on the time axis.

Figure 6:
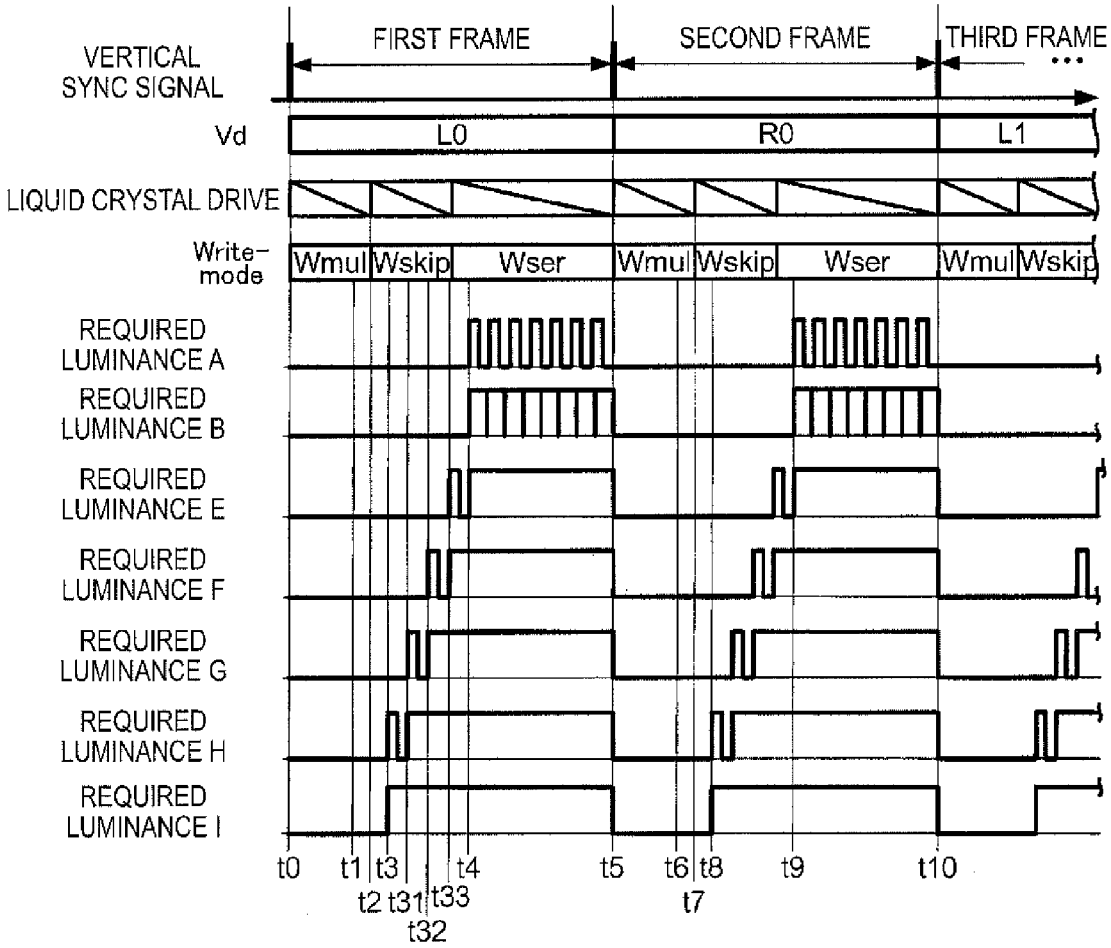
FIG. 6 is an explanatory diagram of an action of a display control section of another example according to the embodiment, and the states of the light modulation device and the light source.
Figure 7:
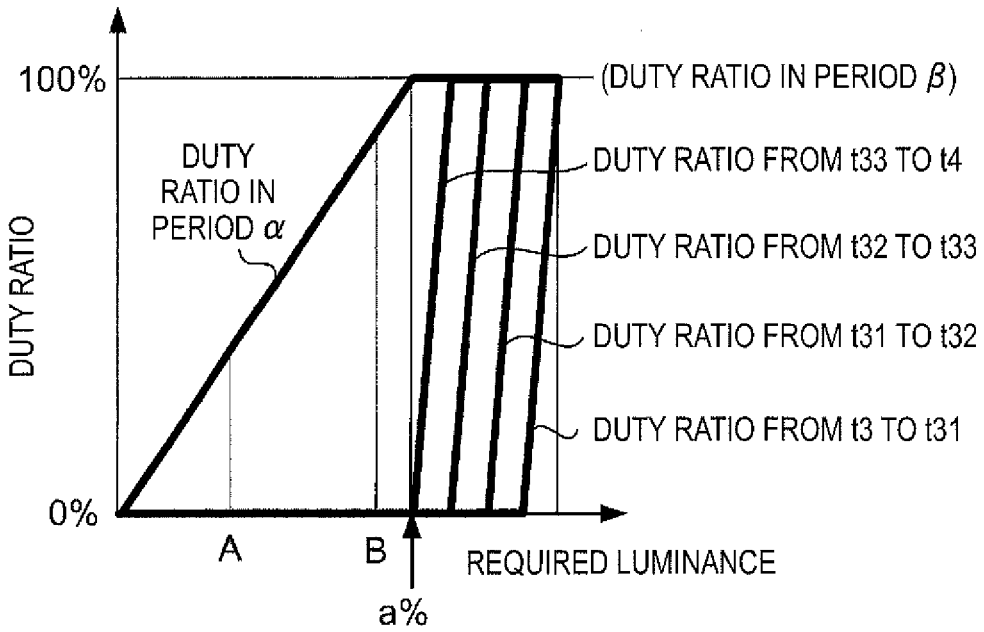
FIG. 7 is an explanatory diagram of a relationship between the required luminance and the duty ratio of the PWM control according to the another example.

FIG. 6 corresponds to FIG. 3, and is a diagram for explaining the action of the display control section 10, and changes in state of the liquid crystal panel 100 and the light source 20 in accordance with the action of the display control section 10. FIG. 7 corresponds to FIG. 5, and is a graph showing the relationship between the required luminance and the duty ratio in the PWM control.

As shown in FIGS. 6 and 7, the display control section 10 divides the period β into four sub-periods (here, equal divide). Then, in the case of irradiating the liquid crystal panel 100 with the light with the required luminance "E" through "I" higher than the threshold value, the display control section 10 puts on the light source 20 while giving a higher priority to the sub-period located at a more posterior position on the time axis.

Specifically, in the first frame, in the case in which the required luminance is "E," the display control section 10 puts off the light source 20 in the period from the time point t3 to the time point t33, and then puts on the light source 20 in a part of the period from the time point t33 to the time point t4. In the case in which the required luminance is "F," the display control section 10 puts off the light source 20 in the period from the time point t3 to the time point t32, then puts on the light source 20 in a part of the period from the time point t32 to the time point t33, and then performs the full-lighting in the entire period from the time point t33 to the time point t4. In the case in which the required luminance is "G," the display control section 10 puts off the light source 20 in the period from the time point t3 to the time point t31, then puts on the light source 20 in a part of the period from the time point t31 to the time point t32, and then performs the full-lighting in the entire period from the time point t32 to the time point t4. In the case in which the required luminance is "H," the display control section 10 puts off the light source 20 in a part of the period from the time point t3 to the time point t31, and then puts on the light source 20 in the entire period from the time point t31 to the time point t4. In the case in which the required luminance is "I," the display control section 10 puts on the light source 20 in the entire period from the time point t3 to the time point t5.

It should be noted that it is preferable for the display control section 10 to put on the light source 20 in the period β also in other odd frames and even frames in a similar manner. Further, although the display control section 10 divides the period β into four sub-periods here, it is also possible to divide the period β into two, three, or five or more sub-periods.

According to this liquid crystal display device 1, even in the case of putting on the light source 20 in the period during which the image with the low resolution is displayed in a part of the liquid crystal panel 100, it is possible to make the image with the low resolution difficult to be visually recognized by the user.

Second Embodiment

Then, a second embodiment of the invention will be explained. In this embodiment, the liquid crystal display device 1 acts so that the period during which the display with the high resolution is displayed in the entire area of the liquid crystal panel 100 is eliminated or shortened. In the following explanation, the constituents identical to the first embodiment are denoted with the same reference symbols, and the explanation thereof will be omitted.

Figure 8:
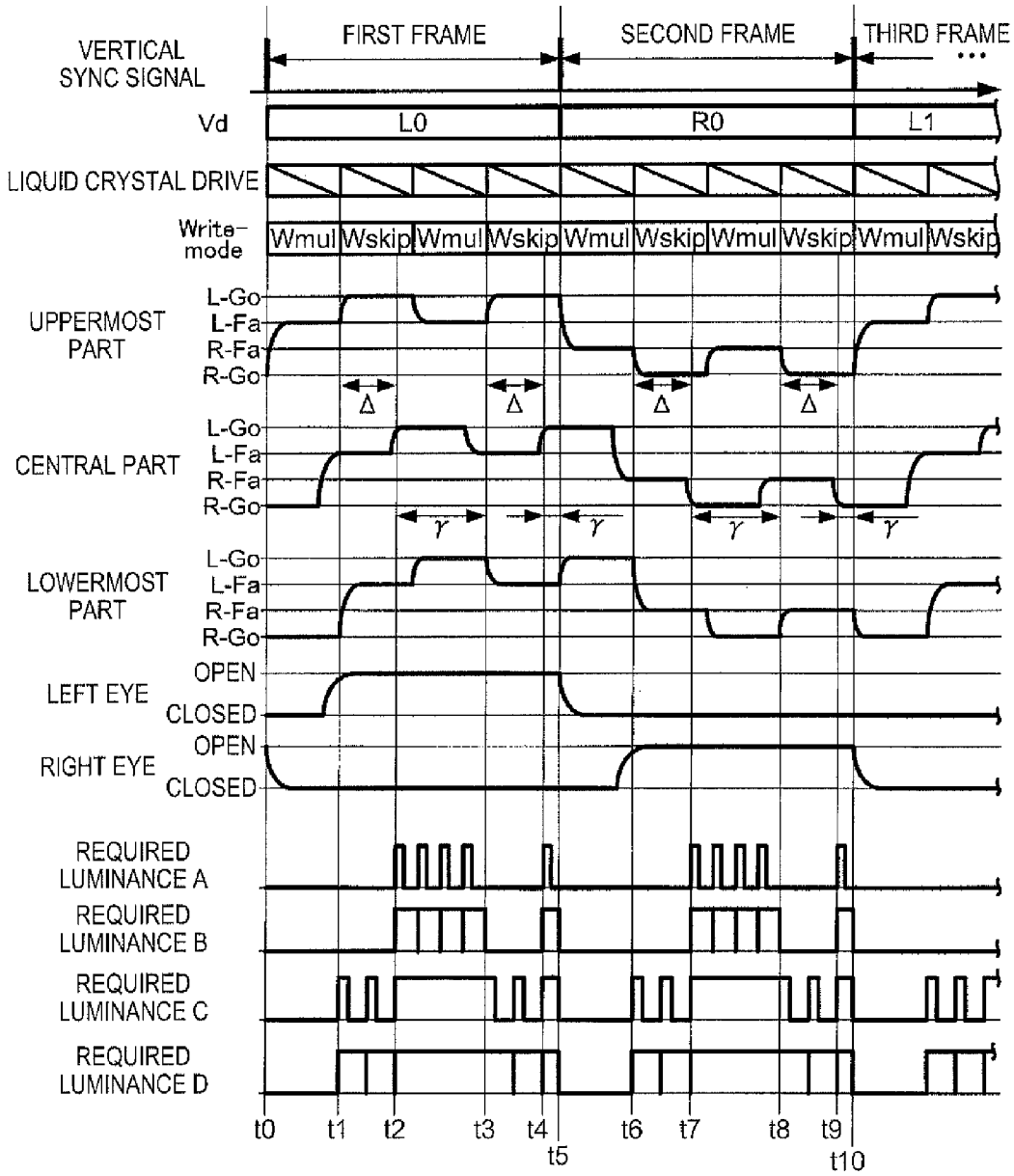
FIG. 8 is an explanatory diagram of an action of a display control section according to a second embodiment of the invention, and states of a light modulation device and a light source.

FIG. 8 corresponds to FIG. 3, and is a diagram for explaining the action of the display control section 10, and changes in state of the liquid crystal panel 100 and the light source 20 in accordance with the action of the display control section 10.

As shown in FIG. 8, the display control section 10 divides one frame into four periods, and selects a writing mode in every period obtained by dividing the frame. The display control section 10 selects the multi-line writing mode Wmul in the image update period, and selects the single-line skip writing mode Wskip in the first display period (a first display period) of the image display period. Further, the display control section 10 selects the multi-line writing mode Wmul in the second display period (a second display period) of the image display period, and selects the single-line skip writing mode Wskip in the third display period (a third display period) of the image display period (see the column of "Write-mode" in FIG. 8).

An action of the display control section 10 in the first frame will be explained.

Similarly to the first embodiment described above, the display control section 10 selects the multi-line writing mode Wmul in the image update period, and selects the single-line skip writing mode Wskip in the first display period of the image display period. The action of the display control section 10 in this period (from the time point t0 to the time point t2 in FIG. 8), and the change in resolution of the display image of the liquid crystal panel 100 are the same as in the first embodiment described above.

When the second display period begins, the display control section 10 selects the multi-line writing mode Wmul, and controls the liquid crystal panel 100 to start writing the data signal for displaying the left-eye image L0 in the liquid crystal panel 100, a transition from the lift-eye image L0 (L-Go) with the high resolution to the left-eye image L0 (L-Fa) with the low resolution occurs in the uppermost part of the screen immediately after the start of the writing. After a further elapse of time, the transition from the lift-eye image L0 (L-Go) with the high resolution to the left-eye image L0 (L-Fa) with the low resolution occurs in the central part of the screen. In retard of the transition, the transition from the lift-eye image L0 (L-Go) with the high resolution to the left-eye image L0 (L-Fa) with the low resolution occurs in the lowermost part of the screen. Then, immediately after the time point t3, the left-eye image L0 with the low resolution is displayed in the entire area of the liquid crystal panel 100.

When the third display period begins, the display control section 10 selects the single-line skip writing mode Wskip, and controls the liquid crystal panel 100 to start writing the data signal for displaying the left-eye image L0. Thus, the liquid crystal panel 100 performs the writing of the data signal in the single-line skip writing mode Wskip from the time point t3 to the time point t5. The change in resolution of the display image due to the present writing operation is the same as in the case of the first display period.

Although the explanation of the action of the display control section 10 regarding the second frame will be omitted, the resolution of the display image changes similarly to the case of the first frame.

As described above, in the liquid crystal display device 1 according to this embodiment, there is no (or little) period during which the image with the high resolution is displayed in the entire area of the liquid crystal panel 100. Therefore, the liquid crystal display device 1 according to the present embodiment determines the period, during which the light source 20 is put on, in accordance with which one of the areas in the liquid crystal panel 100 is the area, namely which one of the scan lines 112 corresponds to the pixels 110 included in the area, the image quality in which has priority.

In general, there is often the case in which important information is concentrated in the vicinity of the central part of the screen of the liquid crystal panel 100 compared to the upper part or the lower part, and the line of sight of the user is directed also at the vicinity of the central part of the screen of the liquid crystal panel 100. In this case; even if the resolution of the image displayed in the upper part and the lower part of the display area 101 of the liquid crystal panel 100 is low, it is difficult for the image with the low resolution to be visually recognized by the user. Therefore, in the present embodiment, the liquid crystal display device 1 puts on the light source 20 in the period, during which the resolution in the vicinity of the central part of the screen of the liquid crystal panel 100 is high, in priority.

As is understood when looking at FIG. 8, it is understood that in the present embodiment, the resolution of the image in the central part (the vicinity of the central part) of the screen is high in the periods γ from the time point t2 to the time point t3 and from the time point t4 to the time point t5. Further, the periods Δ from the time point t1 to the time point t2 and from the time point t3 to the time point t4 are the periods during which the resolution of the image in the central part (the vicinity of the central part) of the screen is low, but no crosstalk occurs even if the image is visually recognized by the user.

Therefore, in the case of irradiating the liquid crystal panel 100 with the light emitted by the light source 20, the display control section 10 performs the PWM control of the light source 20 so as to put on the light source 20 in the periods γ, during which the resolution of the image in the central part (the vicinity of the central part) of the screen is high, in priority. On this occasion, in the case in which the light can be applied with a required luminance even by putting on the light source 20 only in the periods γ, the display control section 10 entirely puts off the light source 20 (i.e., sets the duty ratio to 0%) in the periods Δ. In contrast, in the case in which the light cannot be applied with the required luminance even by putting on (full-lighting at a duty ratio of 100%) the light source 20 only in the periods γ, the display control section 10 puts on (i.e., raises the duty ratio to a level higher than 0%) the light source 20 in the periods Δ.

Figure 9:
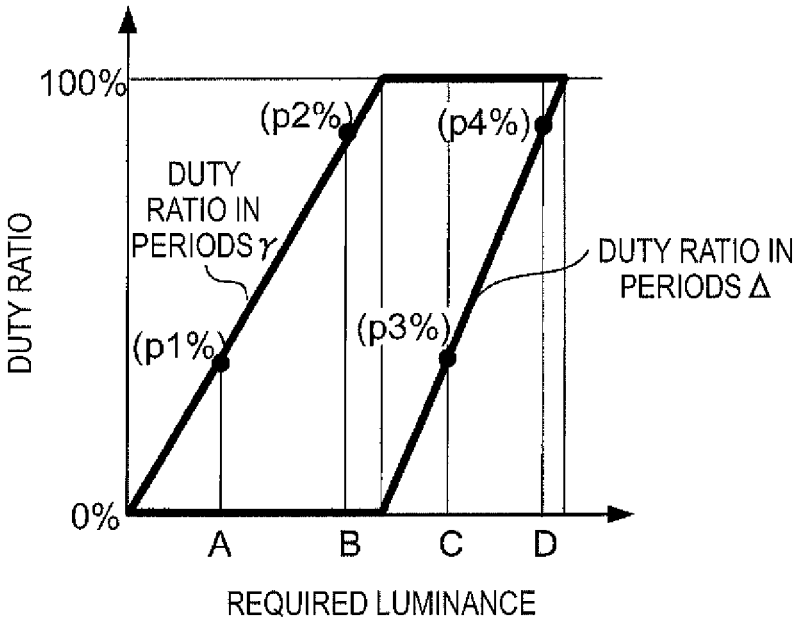
FIG. 9 is an explanatory diagram of a relationship between required luminance and a duty ratio of PWM control according to the embodiment.

FIG. 9 corresponds to FIG. 5, and is a graph showing the relationship between the required luminance and the duty ratio in the PWM control.

As shown in FIGS. 8 and 9, in the case in which the required luminance is "A," the display control section 10 sets the duty ratio in the periods Δ to 0%, and the duty ratio in the periods γ to p1%. In the case in which the required luminance is "B" brighter than "A," the display control section 10 sets the duty ratio in the periods Δ to 0%, and the duty ratio in the periods γ to p2% (where p2>p1).

In the case in which the liquid crystal panel 100 is irradiated with the light with the required luminance without putting on the light source 20 when the image in the central part (the vicinity of the central part) of the screen is low in resolution, the display control section 10 puts on the light source 20 only in the periods γ, and fully puts off the light source 20 in the periods Δ in order to irradiate the liquid crystal panel 100 with the light with the required luminance.

In contrast, in the case in which the required luminance exceeds the luminance (the threshold value) obtained in the case of putting on the light source 20 at full-lighting in the periods γ, the display control section 10 puts on the light source 20 also in the periods Δ in addition to the periods γ. In the case in which the required luminance is "C," the display control section 10 sets the duty ratio in the periods Δ to p3%, and the duty ratio in the periods γ to 100% (full-lighting). In the case in which the required luminance is "D" brighter than "C," the display control section 10 sets the duty ratio in the periods Δ to p4% (where p4>p3), and the duty ratio in the periods γ to 100% (full-lighting).

Even if the required luminance is equal to or higher than the threshold value, the display control section 10 sets the lighting period of the light source 20 in the periods Δ to be as short as possible. Therefore, even in the case of displaying the image at high luminance, it is possible to make the image with the low resolution difficult to be visually recognized by the user.

Although in the above explanation, the liquid crystal display device 1 puts on the light source 20 in the period, during which the resolution of the image in the central part of the screen of the liquid crystal panel 100 is high, in priority, it is also possible to put on the light source 20 in the period, during which the resolution of the image in the upper part or the lower part of the liquid crystal panel 100 is high, in priority.

According to the liquid crystal display device 1 of the present embodiment, even in the case in which there is no or little period during which the image with the high resolution is displayed in the entire area of the liquid crystal panel 100, the brightness of the display image can be ensured while making the image with the low resolution difficult to be visually recognized by the user.

Third Embodiment

Then, a third embodiment of the invention will be explained. In the present embodiment, the liquid crystal display device 1 displays a 2D image. In the following explanation, the constituents identical to the first embodiment are denoted with the same reference symbols, and the explanation thereof will be omitted.

It should be noted that the liquid crystal display device 1 according to the present embodiment is not required to include the constituents related to the display of the 3D image, such as the constituent corresponding to the glass control section 4.

Figure 10:
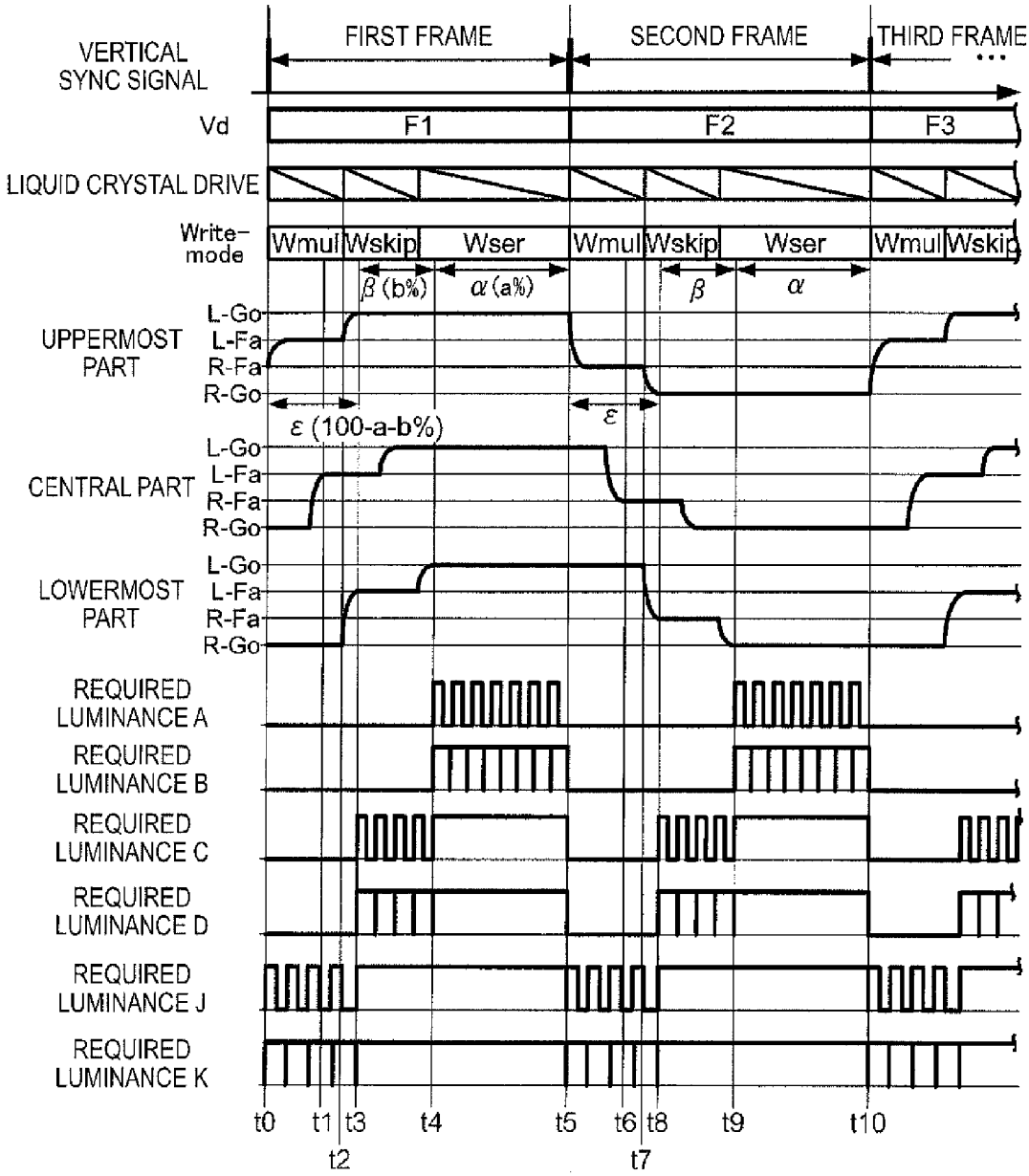
FIG. 10 is an explanatory diagram of an action of a display control section according to a third embodiment of the invention, and states of a light modulation device and a light source.

FIG. 10 corresponds to FIG. 3, and is a diagram for explaining the action of the display control section 10, and changes in state of the liquid crystal panel 100 and the light source 20 in accordance with the action of the display control section 10. As shown in FIG. 10, the display control section 10 controls the liquid crystal panel 100 and the light source 20 to display a frame image F1 in the first frame, and a frame image F2 in the second frame (see the column of "Vd" in FIG. 10). Further, it is assumed that the display control section 10 divides one frame into three periods similarly to the first embodiment, and then selects the writing mode similarly to the first embodiment.

As is understood from the comparison between FIGS. 10 and 3, the temporal changes in resolution in the uppermost part of the screen, the central part of the screen, and the lowermost part of the screen of the liquid crystal panel 100 are the same as in the first embodiment, and therefore, the explanation thereof will be omitted here.

Figure 11:
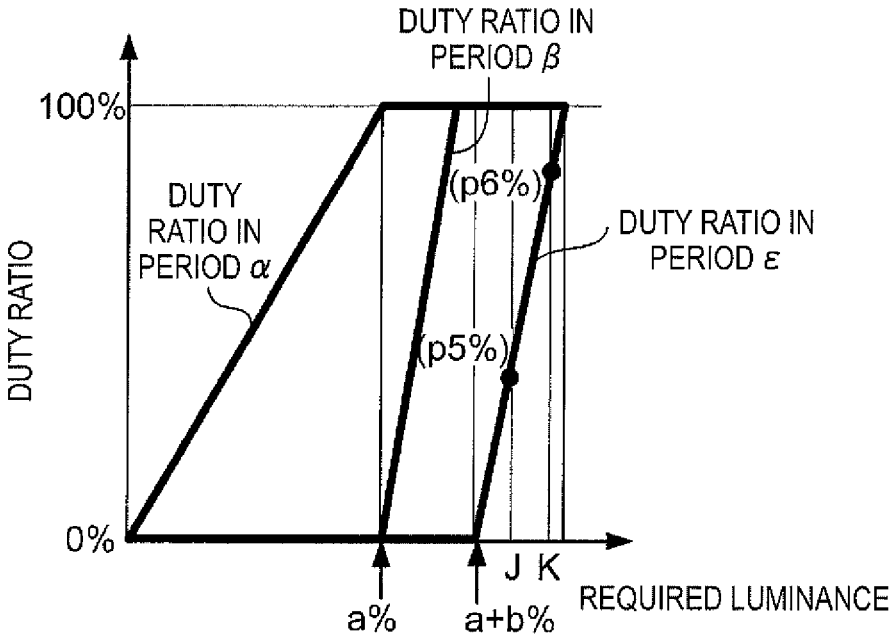
FIG. 11 is an explanatory diagram of a relationship between required luminance and a duty ratio of PWM control according to the embodiment.

FIG. 11 corresponds to FIG. 5, and is a graph showing the relationship between the required luminance and the duty ratio in the PWM control.

As shown in FIGS. 10 and 11, also in the case in which the liquid crystal display device 1 displays the 2D image, the light source 20 is put on while giving a higher priority to the latter part over the early part during the image display period while the light source 20 is fully put off during the image update period similarly to the first embodiment described above in the case in which the required luminance is in a range of "A" through "D." Thus, in the case in which the liquid crystal display device 1 displays the 2D image, it is also possible to further improve the brightness of the display image compared to the case of displaying the 3D image.

Specifically, since in the case of displaying the 2D image, the problem of occurrence of the crosstalk does not arise, it is also possible for the display control section 10 to put on the light source 20 in the image update period. It should be noted that since there occurs in the image update period the state in which the image of the previous frame remains in a part of the liquid crystal panel 100, the display control section 10 puts on the light source 20 in the image display period in priority.

In the case in which the required luminance is "J" brighter than "D," the display control section 10 sets the duty ratio in the period ϵ including the image update period to p5%, and the duty ratio in the periods α and β to 100% (full-lighting). The period α corresponds to the period, the proportion of which in one frame period is a %. The period β corresponds to the period, the proportion of which in one frame period is b %. The period ϵ corresponds to the period, the proportion of which in one frame period is 100-a-b %. In the case in which the required luminance is "K" brighter than "J," the display control section 10 sets the duty ratio in the period ϵ including the image update period to p6% (where p6>p5), and the duty ratio in the periods α and β to 100% (full-lighting).

In the case of displaying the 2D image, the liquid crystal display device 1 fully puts off the light source 20 during the image update period if the light can be applied with the required luminance without putting on the light source 20 in the image update period. In contrast, if it is unachievable to apply the light with the required luminance unless the light source 20 is put on during a period including the image update period, the liquid crystal display device 1 puts on the light source 20 in the image update period to thereby further improve the brightness of the display image.

It should be noted that as in the present embodiment, the configuration of putting on the light source 20 in the image update period can also be applied to the case of displaying the 2D image in the liquid crystal display device 1 according to the second embodiment.

Modified Examples

The invention can be put into practice in some configurations different from the embodiments described above. Further, it is also possible to arbitrarily combine the modified examples described hereinafter with each other.

Although in each of the embodiments described above, the display control section 10 controls the liquid crystal panel 100 to select the scan lines 112 by two lines (i.e., K=2) in the case of selecting the multi-line writing mode Wmul, it is also possible for the display control section 10 to make the liquid crystal panel 100 select the scan lines 112 by a plurality of lines not smaller than three lines (i.e., K≥3). When selecting the multi-line writing mode Wmul, the larger the number of scan lines 112 simultaneously selected by the display control section 10 is set, the lower the vertical resolution becomes, but the shorter the image update period can be set. Since the shorter the image update period is, the longer the image display period can be set, in order to further improve the brightness of the display image of the liquid crystal display device 1, it is preferable to increase the number of scan lines 112 to be selected simultaneously.

Although in each of the embodiments described above, the display control section 10 controls the liquid crystal panel 100 to select the scan lines 112 line by line (i.e., L=1) in the case of selecting the single-line skip writing mode Wskip, it is also possible for the display control section 10 to make the liquid crystal panel 100 select the scan lines 112 by a plurality of lines not smaller than two lines and not larger than (K−1) lines (i.e., 2≤L≤K−1).

The selection method of the writing mode in the display control section 10 of each of the embodiments described above is illustrative only. It is also possible for the display control section 10 to select the writing mode in a sequence different from that in each of the embodiments described above, or to select another writing mode.

Further, it is sufficient for the display control section 10 to make the liquid crystal panel 100 perform writing of the data signal at least once in the image display period. Even in this case, if the display control section 10 gives a higher priority to the lighting in a part of the image display period such as the period during which the image with the high resolution is displayed in the entire area of the liquid crystal panel 100, or the period during which the resolution of the pixels 110 corresponding to the specific scan lines is high, and performs the PWM control so as to have the higher duty ratio than in at least a part of the period other than the image display period, it is possible to ensure the brightness of the display image while making the display image with the low resolution difficult to be visually recognized by the user.

In each of the embodiments described above, the liquid crystal display device 1 makes the liquid crystal shutters 32L, 32R of the pair of 3D glasses 30 make a transition from the closed state to the open state at a timing a time period before the start time of the image display period, wherein the time period corresponds to the time response of the liquid crystal shutters. Instead of this operation, it is also possible for the liquid crystal display device 1 to make the liquid crystal shutters 32L, 32R of the pair of 3D glasses 30 make a transition from the closed state to the open state in sync with the start time of the image display period.

Further, although the pair of 3D glasses 30 use the liquid crystal shutters as the shutters, any shutters capable of controlling the blocking and transmission of the light can be adopted as the shutters, and mechanical shutters can also be adopted besides the liquid crystal shutters.

Although in each of the embodiments described above, the liquid crystal display device 1 divides one frame into a plurality of periods, and writes the data signal a plurality of times, it is also possible to adopt a configuration in which one frame is not divided into a plurality of periods. For example, it is also possible for the liquid crystal display device 1 to display the image in a plurality of frames based on the video signal Vid-in corresponding to one frame, and to change the writing mode frame by frame. For example, if the writing mode is selected in the same sequence as in the first embodiment, the display control section 10 selects the multi-line writing mode Wmul in the first frame, the single-line skip writing mode Wskip in the second frame, and then the single-line sequential writing mode Wser in the third frame, something like that.

In each of the embodiments described above, the liquid crystal display device 1 puts on the light source 20 also in the period β or the periods Δ to thereby set the duty ratio to a level higher than 0% in the case in which it is not achievable to apply the light with the required luminance even if the duty ratio is set to 100% in the period α or the periods γ in which the light source 20 is put on in priority. In stead of this operation, it is also possible for the liquid crystal display device 1 to set the duty ratio in the period β or the periods Δ to a level higher than 0% in the case in which the duty ratio in the period α or the periods γ reaches a predetermined value (e.g., 80%) lower than 100%.

Further, although in each of the embodiments described above, the liquid crystal panel 100 is used as the light modulation device, the invention is not limited to this configuration. Any devices for modulating the incident light in accordance with the image data, in general, can be adopted as the light modulation device, and a micromirror light modulation device or the like can also be used as the light modulation device. As the micromirror light modulation device, a digital micromirror device (DMD), for example, can be used. Further, in the case of using a liquid crystal type light modulation device, either of a transmissive light modulation device and a reflective light modulation device can be used.

The liquid crystal 105 is not limited to the VA liquid crystal. It is also possible to use a liquid crystal other than the VA liquid crystal such as a twisted nematic (TN) liquid crystal. Further, the liquid crystal 105 can also be a liquid crystal of a normally white mode.

Further, the liquid crystal element 120 constituting the pixel 110 is not limited to the transmissive type, but can also be of a reflective type.

Electronic Apparatus

Then, as an example of an electronic apparatus using the liquid crystal display device 1 described above, a projector using the liquid crystal display device 1 will be explained.

Figure 12:
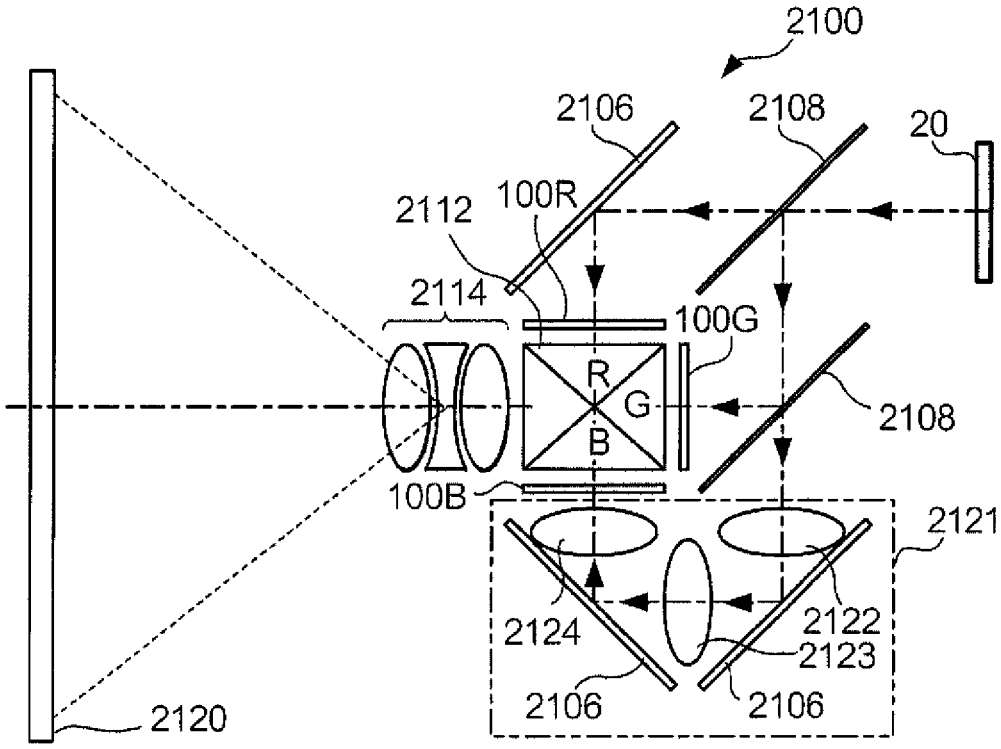
FIG. 12 is a plan view showing a configuration of a projector according to an embodiment of the invention.

FIG. 12 is a plan view showing a configuration of a projector 2100 according to an embodiment of the invention. The projector 2100 is a liquid crystal projector using the liquid crystal panel 100 of the liquid crystal display device 1 as a light valve.

As shown in FIG. 12, the projector 2100 incorporates the light source 20. Here, the light source 20 is a white light source such as a light emitting diode. Projection light emitted from the light source 20 is separated into three primary colors of R color, C color, and B color by three mirrors 2106 and two dichroic mirrors 2108, and then respectively guided to the light valves 100R, 100G, and 100B corresponding to the respective primary colors.

It should be noted that the light of the E color has a longer light path compared to the other colors, the R color and the G color, and is therefore guided via a relay lens system 2121 composed of an entrance lens 2122, a relay lens 2123, and an exit lens 2124 in order to prevent the loss in the light path.

In the projector 2100, the three sets of liquid crystal display devices 1 are disposed corresponding respectively to the R color, the G color, and the B color. Further, the video signals corresponding respectively to the R color, the G color, and the B color are supplied from a higher-level device. The light valves 100R, 1000, and 100B are respectively driven in accordance with the video signals corresponding respectively to the R color, the G color, and the B color.

The lights modulated respectively by the light valves 100R, 100G, and 1003 enter the dichroic prism 2112 in three directions. Then, in the dichroic prism 2112, the lights of the R color and the B color are refracted 90 degrees while the light of the G color goes straight. Therefore, after the images of the respective colors are combined, the color image is projected by the projection lens 2114 to the screen 2120.

Since the lights corresponding respectively to the R color, the G color, and the B color enter the light valves 100R, 100G, and 1003 due to the dichroic mirrors 2108, no color filter is required to be disposed. Further, since the transmission images of the light valves 100R, 100B are reflected by the dichroic prism 2112 and then projected while the transmission image of the light valve 100G is projected directly, there is adopted the configuration in which the horizontal scanning direction of the light valves 100R, 100B is set to the reverse direction of the horizontal scanning direction of the light valve 100G to thereby display the mirror reversed images.

The display device according to the invention is not limited to a projector. As the display device according to the invention, there can be cited a television set, a video tape recorder of a viewfinder type or a monitor direct-view type, a car navigation system, a pager, a personal digital assistance, an electronic calculator, a word processor, a workstation, a picture phone, a PCS terminal, a digital still camera, a cellular phone, equipment provided with a tough panel, and so on.

What is claimed is:

1. A display device comprising:

a light modulation device including a plurality of pixels disposed corresponding to respective intersections between a plurality of scan lines and a plurality of data lines;

a light source adapted to irradiate the light modulation device with light in accordance with pulse width modulation (PWM) control;

a light modulation device control section adapted to control the light modulation device to:

select the plurality of scan lines by K lines (K is an integer not smaller than 2), and then write a data signal into the pixels corresponding to the selected scan lines in an image update period, the image update period being a period for updating an image to be displayed by the light modulation device from the previous frame to the present frame, select at least a part of the plurality of scan lines, line by line, and then write the data signal into the pixels corresponding to the selected scan line in an image display period subsequent to the image update period, write the data signal corresponding to a designated grayscale of the pixels corresponding to a first scan line of the plurality of scan lines in the image update period, and select a second scan line, which is other than the first scan line of the plurality of scan lines, and then write the data signal corresponding to a designated grayscale of the pixels corresponding to the selected second scan line in a first display period in the image display period, and select the plurality of scan lines by K lines and then write the data signal into the pixels corresponding to the selected scan lines in a second display period subsequent to the first display period; and a light source control section adapted to:

perform the PWM control of the light source so as to set a duty ratio in a part of the image display period to be higher than the duty ratio in another part of the image display period when the light modulation device is irradiated with the light with a predetermined luminance, and set a duty ratio in a period from when writing of the data signal is performed in the first display period to when writing of the data signal is performed in the second display period to be higher than the duty ratio in the another part of the image display period.

2. The display device according to claim 1, wherein the light source control section sets the duty ratio in the another part of the image display period to 0% when the light modulation device is irradiated with the light with the luminance equal to and lower than a threshold value, and the duty ratio in the part of the image display period to 100%, and the duty ratio in the another part of the image display period to be higher than 0% when the light modulation device is irradiated with the light with the luminance higher than the threshold value.

3. The display device according to claim 1, wherein the light modulation device control section controls the light modulation device to:

write the data signal corresponding to a designated grayscale of the pixels corresponding to a first scan line of the plurality of scan lines in the image update period, and select a second scan line, which is other than the first scan line of the plurality of scan lines, and then write the data signal corresponding to a designated grayscale of the pixels corresponding to the selected second scan line in a first display period in the image display period, and select the plurality of scan lines, line by line, and then write the data signal into the pixels corresponding to the selected one of the scan lines in a second display period subsequent to the first display period, and the light source control section sets the duty ratio in the second display period to be higher than the duty ratio in the first display period.

4. The display device according to claim 3, wherein when the light modulation device is irradiated with the light in the first display period, the light source control section temporally divides the first display period into a plurality of sub-periods, and sets the duty ratio so that the more posterior the sub-period is located on a time axis, the higher the duty ratio in the sub-period is.

5. The display device according to claim 1, wherein the light modulation device control section controls the light modulation device to select the second scan line, and then write the data signal corresponding to a designated grayscale of the pixels corresponding to the selected second scan line in a third display period after the second display period in the image display period, and the light source control section sets a duty ratio in a period from when writing of the data signal is performed in the third display period to when the third display period ends to be higher than the duty ratio in the another part of the image display period.

6. The display device according to claim 1, wherein the light modulation device control section controls the light modulation device to write the data signal representing one of a left-eye image and a right-eye image in 3D image display, and the light source control section sets a duty ratio in the image update period to 0%.

7. The display device according to claim 1, wherein the light modulation device control section controls the light modulation device to write the data signal representing a 2D image, and the light source control section sets a duty ratio in the image update period to be higher than 0% when the duty ratio in the image display period is 100%.

8. A display control method of a display device, comprising:

providing the display device with a light modulation device including a plurality of pixels disposed corresponding to respective intersections between a plurality of scan lines and a plurality of data lines, and a light source adapted to irradiate the light modulation device with light in accordance with pulse width modulation (PWM) control;

selecting the plurality of scan lines by K lines (K is an integer not smaller than 2), and then writing a data signal into the pixels corresponding to the selected scan lines in an image update period, the image update period being a period for updating an image to be displayed by the light modulation device from the previous frame to the present frame;

selecting at least a part of the plurality of scan lines, line by line, and then writing the data signal into the pixels corresponding to the selected scan line in an image display period subsequent to the image update period;

writing the data signal corresponding to a designated grayscale of the pixels corresponding to a first scan line of the plurality of scan lines in the image update period:

selecting a second scan line, which is other than the first scan line of the plurality of scan lines, and then writing the data signal corresponding to a designated grayscale of the pixels corresponding to the selected second scan line in a first display period in the image display period, and selecting, the plurality of scan lines by K lines and then writing the data signal into the pixels corresponding to the selected scan lines in a second display period subsequent to the first display period;

performing the PWM control of the light source so as to set a duty ratio in a part of the image display period to be higher than the duty ratio in another part of the image display period when the light modulation device is irradiated with the light with a predetermined luminance; and setting a duty ratio in a period from when writing of the data signal is performed in the first display period to when writing of the data signal is performed in the second display period to be higher than the duty ratio in the another part of the image display period.

9. A display device comprising:

a light modulation device including a plurality of pixels disposed corresponding to respective intersections between a plurality of scan lines and a plurality of data lines;

a light source adapted to irradiate the light modulation device with light in accordance with pulse width modulation (PWM) control;

a light modulation device control section adapted to control the light modulation device to:

select the plurality of scan lines by K lines (K is an integer not smaller than 2), and then write a data signal into the pixels corresponding to the selected scan lines in an image update period, the image update period being a period for updating an image to be displayed by the light modulation device from the previous frame to the present frame, and select the plurality of scan lines by L lines (L is an integer not smaller than 1 and not larger than K-1), and then write the data signal into the pixels corresponding to the selected scan lines in an image display period subsequent to the image update period, write the data signal corresponding to a designated grayscale of the pixels corresponding to a first scan line of the plurality of scan lines in the image update period and select a second scan line, which is other than the first scan line of the plurality of scan lines and then write the data signal corresponding to a designated grayscale of the pixels corresponding to the selected second scan line in a first display period in the image display period, and select the plurality of scan lines by K lines and then write the data signal into the pixels corresponding to the selected scan lines in a second display period subsequent to the first display period; and a light source control section adapted to:

perform the PWM control of the light source so as to set a duty ratio in a part of the image display period to be higher than the duty ratio in another part of the image display period when the light modulation device is irradiated with the light with a predetermined luminance, and set a duty ratio in a period from when writing of the data signal is performed in the first display period to when writing of the data signal is performed in the second display period to be higher than the duty ratio in the another part of the image display period.

* * * * *